US012582199B2

(12) United States Patent
Matsumoto et al.

(10) Patent No.: US 12,582,199 B2
(45) Date of Patent: Mar. 24, 2026

(54) SHOE AND METHOD OF MANUFACTURING SHOE

(71) Applicant: ASICS CORPORATION, Kobe (JP)

(72) Inventors: Yusuke Matsumoto, Kobe (JP); Ryota Kitami, Kobe (JP); Noritaka Okada, Kobe (JP)

(73) Assignee: ASICS CORPORATION (JP)

( * ) Notice: Subject to any disclaimer, the term of this patent is extended or adjusted under 35 U.S.C. 154(b) by 0 days.

(21) Appl. No.: 18/451,276

(22) Filed: Aug. 17, 2023

(65) Prior Publication Data

US 2024/0057719 A1 Feb. 22, 2024

(30) Foreign Application Priority Data

Aug. 18, 2022 (JP) ..... 2022-130383

(51) Int. Cl.

| | |
|---|---|
| ***A43B 23/02*** | (2006.01) |
| ***A43B 1/02*** | (2022.01) |
| ***A43C 11/00*** | (2006.01) |

(52) U.S. Cl.

CPC ..... *A43B 23/025* (2013.01); *A43B 1/02* (2013.01); *A43B 23/027* (2013.01); *A43B 23/0295* (2013.01); *A43C 11/002* (2013.01)

(58) Field of Classification Search

CPC . A43B 23/025; A43B 23/027; A43B 23/0295; A43B 1/02; A43C 11/02; A43C 1/00; A43C 1/04; A43C 5/00

See application file for complete search history.

(56) References Cited

U.S. PATENT DOCUMENTS

| | | | | |
|---|---|---|---|---|
| D348,976 | S * | 7/1994 | Van Noy | D2/907 |
| D781,566 | S * | 3/2017 | Nethongkome | D2/972 |
| 2013/0019501 | A1* | 1/2013 | Gerber | A43C 1/04 36/50.1 |

(Continued)

FOREIGN PATENT DOCUMENTS

| | | |
|---|---|---|
| DE | 1875053 U | 7/1963 |
| WO | 20150151195 | 10/2015 |
| WO | 2022/123620 A1 | 6/2022 |

OTHER PUBLICATIONS

Office Action for corresponding Japanese Application No. 2022-130383 dated Mar. 26, 2024, 8 pages.

(Continued)

*Primary Examiner* — Haley A Smith

(74) *Attorney, Agent, or Firm* — Morgan, Lewis & Bockius LLP

(57) ABSTRACT

In a shoe, an upper has an opening through which a foot of a wearer is inserted when the wearer puts on the shoe, and includes a shoelace tightening region located forward of the opening. A tape member is higher in rigidity than the upper body. A first portion is located in the shoelace tightening region and extends in a front-rear direction of the upper. A folded portion is contiguous to at least one of a front end portion and a rear end portion of the first portion. The folded portion is formed by folding the tape member downward when viewed from the first portion. A second portion extends downward from the folded portion. The first portion is sewn onto the upper body such that gaps through which a shoelace passes are provided between the first portion and the upper body.

16 Claims, 10 Drawing Sheets

(56) References Cited

U.S. PATENT DOCUMENTS

| | | | | |
|---|---|---|---|---|
| 2016/0174661 | A1* | 6/2016 | Nonogawa | A43B 23/0245 36/88 |
| 2016/0345673 | A1* | 12/2016 | Humphrey | A43C 19/00 |
| 2017/0143075 | A1* | 5/2017 | Nonogawa | A43B 23/0275 |
| 2022/0312897 | A1* | 10/2022 | Wehrmeyer | A43C 1/04 |
| 2024/0023676 | A1 | 1/2024 | Tateno | |
| 2024/0237785 | A1* | 7/2024 | Mazzarolo | A43C 1/003 |

OTHER PUBLICATIONS

Office Action issued in corresponding Japanese Patent Application No. 2022-130383 dated Mar. 26, 2024.
Office Action issued in corresponding Japanese Patent Application No. 2024-087823, dated Mar. 4, 2025.

* cited by examiner

SHOE AND METHOD OF MANUFACTURING SHOE

CROSS REFERENCE TO RELATED APPLICATIONS

This nonprovisional application is based on Japanese Patent Application No. 2022-130383 filed on Aug. 18, 2022 with the Japan Patent Office, the entire contents of which are hereby incorporated by reference.

BACKGROUND OF THE INVENTION

Field of the Invention

The present disclosure relates to a shoe and a method of manufacturing the shoe.

Description of the Background Art

International Publication No. 2015/151195 discloses a conventional shoe. An upper of the shoe includes a sock portion, outer and inner eyelet portions, at least one outer reinforcing member, and at least one inner reinforcing member.

The outer and inner eyelet portions are disposed respectively on the outer and inner edges of an opening of the sock portion. The outer and inner eyelet portions are less stretchable than the member forming the sock portion. The outer and inner eyelet portions each have a plurality of holes through which a shoelace passes. Examples of the material forming each eyelet portion may include a tape material, artificial leather, or two or more of these materials. The plurality of holes through which the shoelace passes may be small circular holes provided in artificial leather or the like, or may be provided by loop materials sewn into artificial leather or the like.

The outer reinforcing member is less stretchable than the member forming the sock portion. The outer reinforcing member extends from the outer eyelet portion to reach a sole or a heel counter. The inner reinforcing member is less stretchable than the member forming the sock portion. The inner reinforcing member extends from the inner eyelet portion to reach the sole or the heel counter.

SUMMARY

In the shoe disclosed in International Publication No. 2015/151195, for providing a plurality of holes through which the shoelace passes, it is necessary to provide a plurality of holes directly in the eyelet portion or to prepare another member separately from the eyelet portion. Further, in order to provide the plurality of holes, it is necessary to mold a member for reinforcement (a reinforcing member) into a desired shape. In this way, in the shoe in which the reinforcing member is disposed on the outer surface of an upper body, there is room for improvement in production efficiency by simplifying the processing of the reinforcing member and the configuration of the reinforcing member itself.

The present disclosure has been made in view of the above-described problems, and an object of the present disclosure is to provide: a shoe including an upper body with a surface having a reinforcing member disposed thereon and improved in production efficiency; and a method of manufacturing the shoe.

A shoe according to the present disclosure includes a sole and an upper. The upper is located above the sole, has an opening through which a foot of a wearer is inserted when the wearer puts on the shoe, and includes a shoelace tightening region located forward of the opening. The upper includes an upper body and a tape member having a tape shape. The upper body is capable of, together with the sole, accommodating the foot of the wearer. The tape member is sewn onto an outer surface of the upper body. The tape member is higher in rigidity than the upper body. The tape member includes a first strip-shaped portion, a folded portion, and a second strip-shaped portion. The first strip-shaped portion is located in the shoelace tightening region and extends in a front-rear direction of the upper. The folded portion is contiguous to at least one of a front end portion and a rear end portion of the first strip-shaped portion. The folded portion is formed by folding the tape member downward when viewed from the first strip-shaped portion. The second strip-shaped portion extends downward from the folded portion. The first strip-shaped portion is sewn onto the upper body such that a plurality of gaps through which a shoelace passes are provided between the first strip-shaped portion and the upper body.

A method of manufacturing a shoe according to the present disclosure includes: preparing a sole; manufacturing an upper having an opening through which a foot of a wearer is inserted when the wearer puts on the shoe, the upper including a shoelace tightening region located forward of the opening; and joining the upper to a top side of the sole. The manufacturing an upper includes: preparing an upper body capable of, together with the sole, accommodating the foot of the wearer; forming a folded portion by folding a tape member having a tape shape along a fold portion, the tape member being higher in rigidity than the upper body; sewing a first strip-shaped portion of the tape member onto an outer surface of the upper body so as to be located in the shoelace tightening region and to extend in a front-rear direction of the upper, the first strip-shaped portion being a portion on one side in the tape member when viewed from the folded portion; and attaching a second strip-shaped portion of the tape member to the outer surface of the upper body so as to extend downward from the folded portion, the second strip-shaped portion being a portion on the other side in the tape member when viewed from the folded portion. The first strip-shaped portion is sewn onto the upper body such that a plurality of gaps through which the shoelace passes are provided between the first strip-shaped portion and the upper body.

The foregoing and other objects, features, aspects, and advantages of the present invention will become apparent from the following detailed description of the present invention, which is understood in conjunction with the accompanying drawings.

DESCRIPTION OF THE PREFERRED EMBODIMENTS

Figure 1:
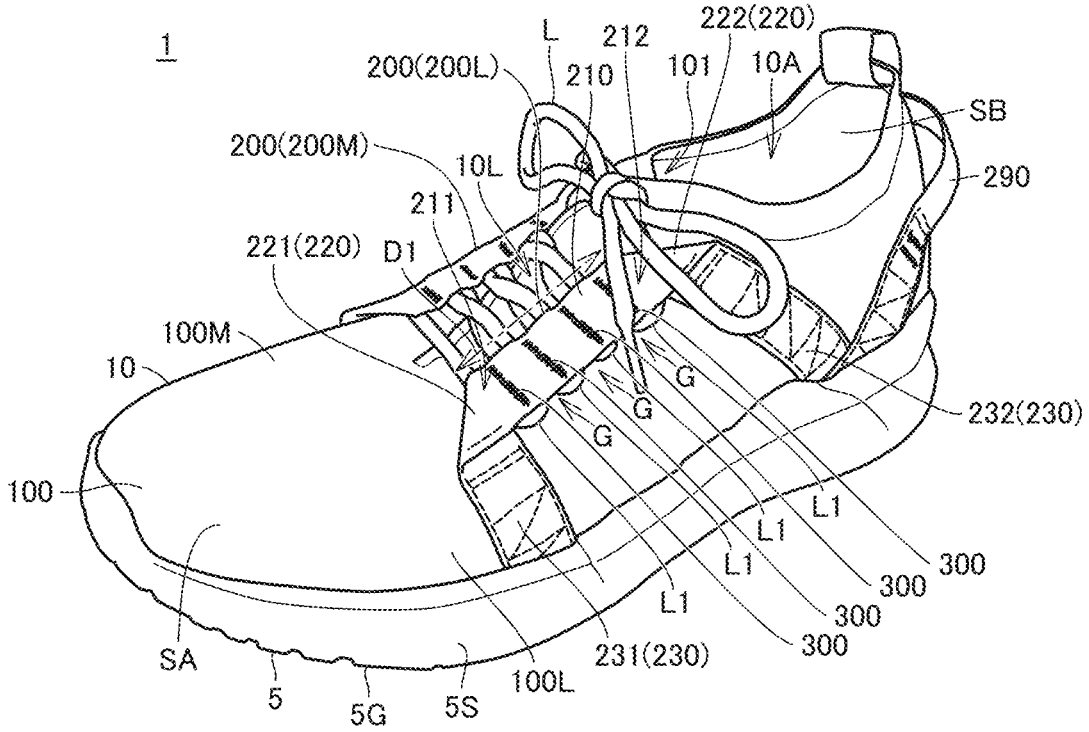
FIG. 1 is a perspective view showing a shoe according to a first embodiment of the present disclosure when viewed from a lateral foot side.

The following describes a shoe according to each of embodiments of the present disclosure and a method of manufacturing the shoe with reference to the accompanying drawings. In the following description of each of the embodiments, the same or corresponding portions in the accompanying drawings are denoted by the same reference characters, and the description thereof will not be repeated.

As used herein, an "up-down direction" means a direction orthogonal to the ground when a shoe sole is placed on a flat ground such that a ground contact surface of the shoe sole is in contact with the ground. As used herein, "upward" means a direction opposite to the ground when viewed from a sole. As used herein, "downward" means a direction toward the ground when viewed from the sole. As used herein, "front" or "forward" means a direction in which a wearer of shoes faces. As used herein, "rear" or "rearward" means a direction opposite to "front" or "forward". As used herein, a "front-rear direction" means a direction extending "forward" and "rearward". As used herein, a "foot width direction" is a direction substantially orthogonal to both the "up-down direction" and the "front-rear direction".

When simply referred to as a "medial foot side" in the present specification, it means the side of a portion of a shoe that accommodates the medial foot side (a medial side of the foot in anatomical position) of a foot of a wearer of the shoe with respect to the center of the shoe in the foot width direction. When simply referred to as a "lateral foot side" in the present specification, it means the side of a portion of the shoe that accommodates the lateral foot side (the side opposite to the medial side of the foot in anatomical position) of the foot of the wearer of the shoe with respect to the center of the shoe in the foot width direction.

Further, the following description about each of the configurations of the shoe in the present specification explains each configuration in the state in which the wearer is not wearing the shoe except for the description of the state in which the wearer is wearing the shoe.

First Embodiment

[Shoe]

Figure 2:
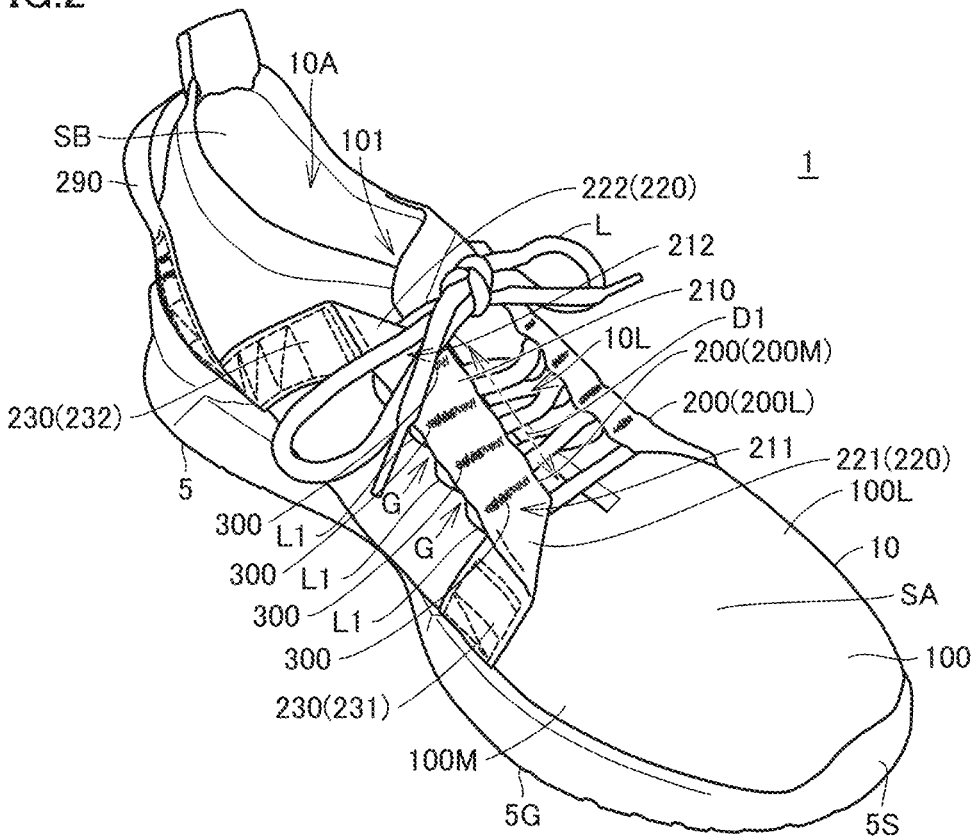
FIG. 2 is a perspective view showing the shoe according to the first embodiment of the present disclosure when viewed from a medial foot side.
Figure 3:
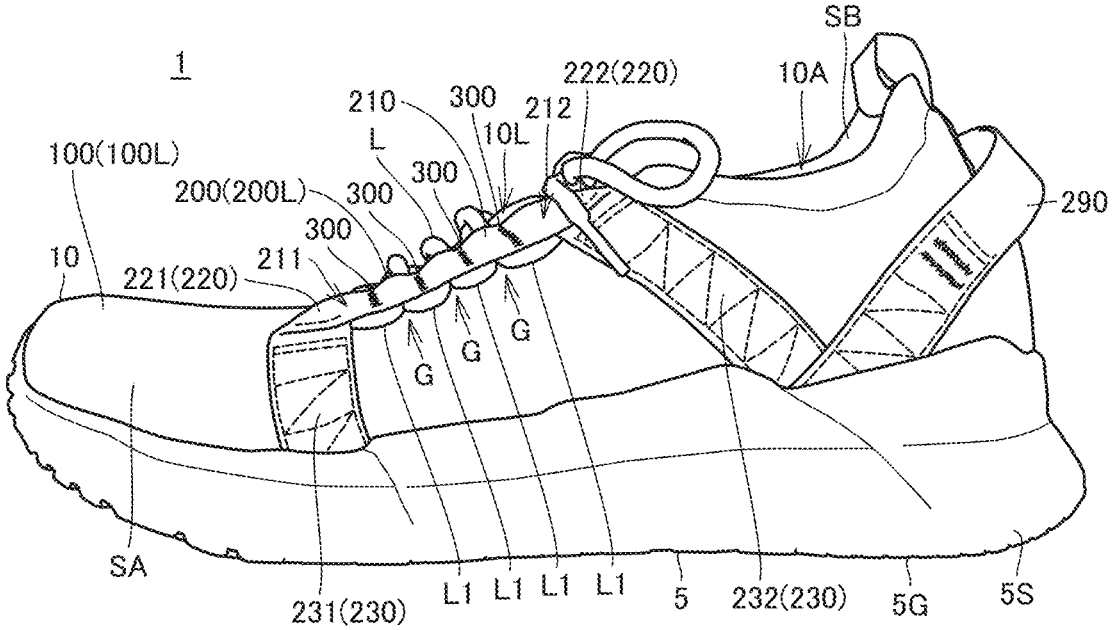
FIG. 3 is a side view showing the shoe according to the first embodiment of the present disclosure when viewed from the lateral foot side.
Figure 4:
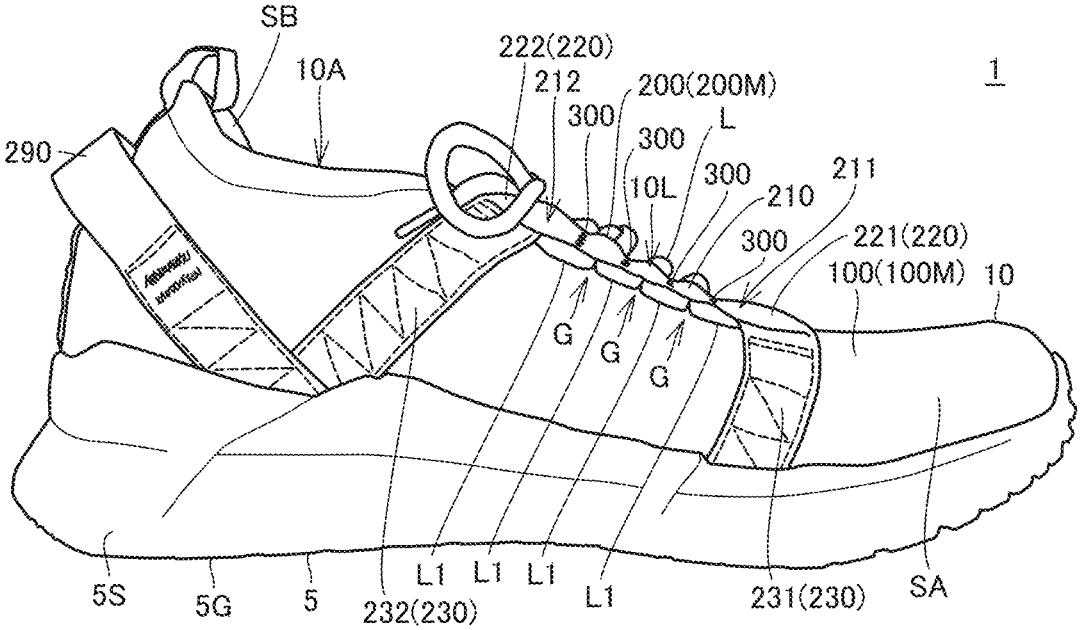
FIG. 4 is a side view showing the shoe according to the first embodiment of the present disclosure when viewed from the medial foot side.
Figure 5:
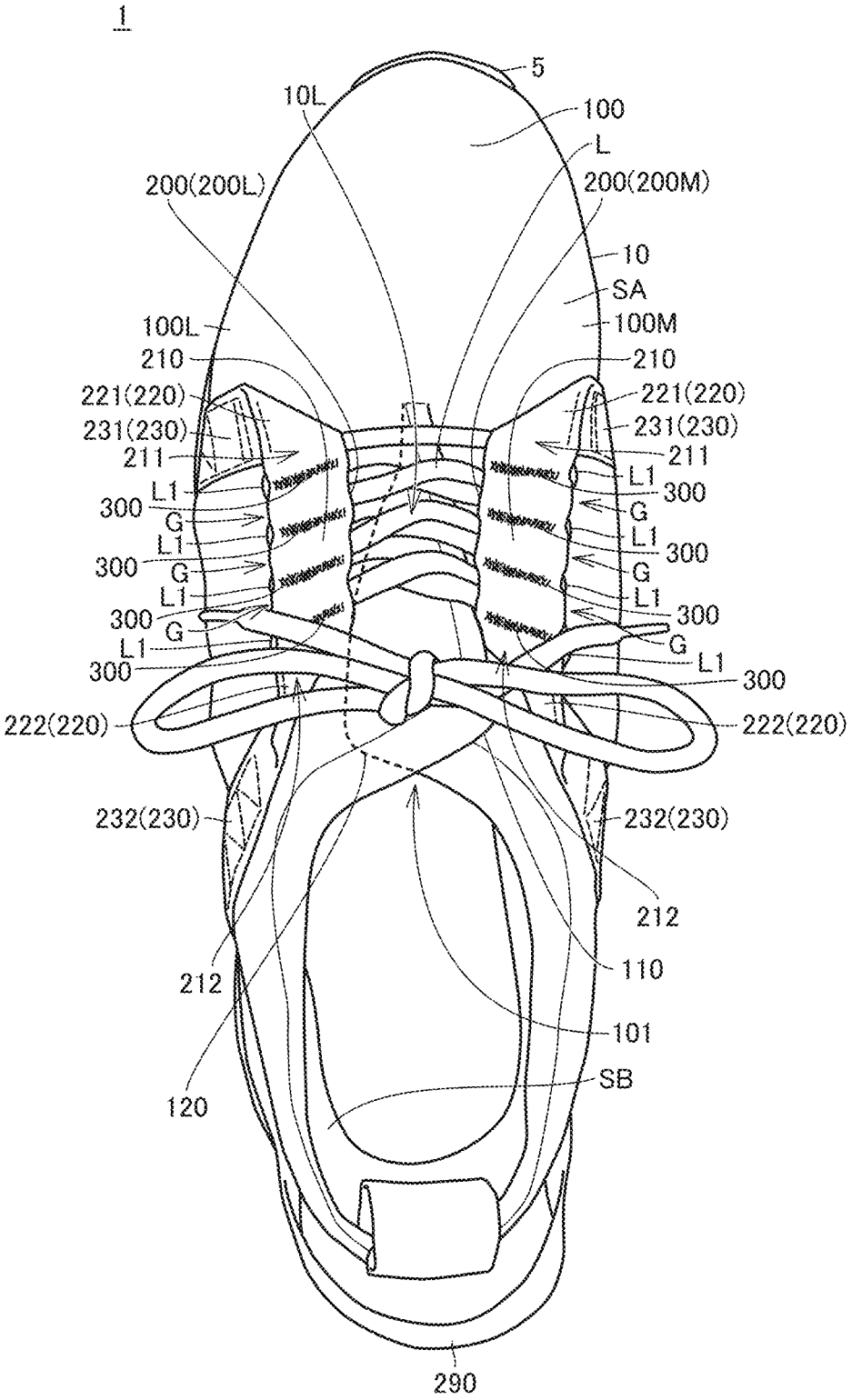
FIG. 5 is a plan view showing the shoe according to the first embodiment of the present disclosure.

FIG. 1 is a perspective view showing a shoe according to the first embodiment of the present disclosure when viewed from a lateral foot side. FIG. 2 is a perspective view showing the shoe according to the first embodiment of the present disclosure when viewed from a medial foot side. FIG. 3 is a side view showing the shoe according to the first embodiment of the present disclosure when viewed from the lateral foot side. FIG. 4 is a side view showing the shoe according to the first embodiment of the present disclosure when viewed from the medial foot side. FIG. 5 is a plan view showing the shoe according to the first embodiment of the present disclosure. As shown in FIGS. 1 to 5, a shoe 1 according to the first embodiment of the present disclosure includes a sole 5 and an upper 10.

The sole 5 has a ground contact surface 5G and a peripheral side surface 5S. The peripheral side surface 5S extends upward from a peripheral edge of the ground contact surface 5G.

The material of the sole 5 is not particularly limited, but the entire sole 5 is preferably made of a single polymer composition, for example, from the viewpoint of improving the production efficiency. For example, from the viewpoint of improving the shock absorbing performance, the polymer composition more preferably contains a component composed of at least one of a mono-polymer containing Farnesene as a constituent unit or a copolymer containing Farnesene as a constituent unit.

The upper 10 is located above the sole 5. The upper 10 has an opening 10A and includes a shoelace tightening region 10L. The opening 10A is provided to allow a foot of a wearer of the shoe to be inserted therethrough when the wearer puts on the shoe. The shoelace tightening region 10L is located forward of the opening 10A. The components disposed in the shoelace tightening region 10L will be described later.

The upper 10 includes an upper body 100, at least one tape member 200, and a plurality of stitch portions 300.

First, the upper body 100 will be described. The upper body 100 is configured to be capable of, together with the sole 5, accommodating the wearer's foot.

The upper body 100 is formed of a lateral foot portion 100L and a medial foot portion 100M. The lateral foot portion 100L is located mainly on the lateral foot side. The medial foot portion 100M is located mainly on the medial foot side. The medial foot portion 100M is connected to the lateral foot portion 100L. More specifically, the medial foot portion 100M is connected to the lateral foot portion 100L at a position forward of the shoelace tightening region 10L.

Further, the medial foot portion 100M is connected to the lateral foot portion 100L at a position rearward of the opening 10A.

The upper body 100 has a slit 101. The slit 101 extends forward from the opening 10A to be located in the shoelace tightening region 10L such that the lateral foot portion 100L and the medial foot portion 100M are separated from each other (see FIG. 5).

As shown in FIG. 5, the lateral foot portion 100L includes a first extending portion 110. The first extending portion 110 is a portion on one side of the upper body 100 with respect to the slit 101. In other words, the first extending portion 110 is located in the shoelace tightening region 10L. The first extending portion 110 extends toward the medial foot side. The first extending portion 110 is configured to be capable of overlapping with the medial foot portion 100M when viewed from above.

The medial foot portion 100M includes a second extending portion 120. The second extending portion 120 is a portion on the other side of the upper body 100 with respect to the slit 101. In other words, the second extending portion 120 is located in the shoelace tightening region 10L. The second extending portion 120 extends toward the lateral foot side. The second extending portion 120 is configured to be capable of overlapping with the lateral foot portion 100L when viewed from above.

The upper body 100 is formed of a knitted fabric. Thus, the shoe according to the present embodiment achieves an improved feel of contact for the wearer's foot. Further, in the process of manufacturing the upper body 100 formed of a knitted fabric, an outer-shape molding step such as die cutting can also be omitted. Thus, the production efficiency of the shoe 1 can be improved. From the viewpoint of recyclability, the knitted fabric is preferably made of fibers containing a polyester resin as a main component.

The tape member 200 will then be described. The tape member 200 has a tape-like outer shape having a width dimension that is substantially constant in its extending direction. The width dimension of the tape member 200 is 3 mm to 50 mm, for example. The tape member 200 is sewn onto an outer surface SA of the upper body 100. The tape member 200 is higher in rigidity than the upper body 100 while having flexibility. From the viewpoint of recyclability, the tape member 200 is preferably made of a resin composition containing a polyester resin as a main component. From the viewpoint of environmental load reduction, the polyester resin is more preferably made of recycled raw materials, and further preferably made of only recycled raw materials.

The upper 10 should only include at least one tape member 200, but in the present embodiment, the upper 10 includes a plurality of tape members 200. Specifically, the tape member 200 includes: a lateral foot-side tape member 200L attached to the outer surface SA of the upper body 100 on the lateral foot side; and a medial foot-side tape member 200M attached to the outer surface SA of the upper body 100 on the medial foot side. Thus, in the shoe 1 according to the present embodiment, the tape member 200 is provided in the upper body 100 on both the lateral and medial foot sides, so that the fitted feel to the shoe 1 is further improved.

In the present embodiment, the lateral foot-side tape member 200L and the medial foot-side tape member 200M are formed of separate tape members but may be formed of a single contiguous tape member (a modification thereof will be described later). The lateral foot-side tape member 200L and the medial foot-side tape member 200M may have different configurations, but there may also be a case where the lateral foot-side tape member 200L and the medial foot-side tape member 200M have the same configuration in the present embodiment. Thus, in the following description of the present embodiment, when simply referred to as the "tape member 200", the tape member 200 may be understood as the lateral foot-side tape member 200L or the medial foot-side tape member 200M.

The tape member 200 includes a first strip-shaped portion 210, at least one folded portion 220, and at least one second strip-shaped portion 230.

The first strip-shaped portion 210 is located in the shoelace tightening region 10L and extends in the front-rear direction of the upper 10. More specifically, the first strip-shaped portion 210 extends in the front-rear direction and is located to be inclined downward toward the front side (see FIGS. 3 and 4). Further, the first strip-shaped portion 210 may extend in the front-rear direction and may be inclined to one of the lateral foot side and the medial foot side in the foot width direction toward the front side (see FIG. 5).

The first strip-shaped portion 210 is sewn onto the upper body 100 such that a plurality of gaps G through which a shoelace L passes are provided between the first strip-shaped portion 210 and the upper body 100. Specifically, the first strip-shaped portion 210 is sewn onto the upper body 100 through the plurality of stitch portions 300 (the details of the stitch portions 300 will be described later).

The lateral foot portion 100L and the medial foot portion 100M are configured in such a manner that the lateral foot portion 100L and the medial foot portion 100M located on both sides of the slit 101 in the foot width direction overlap with each other by tightening the shoelace L passing through the plurality of gaps G between the first strip-shaped portion 210 and the upper body 100. Thereby, even when the upper 10 does not have a shoe tongue, the wearer's foot can be wrapped with the upper 10 in the shoelace tightening region 10L. Thus, the above-described configuration allows simplified configurations of the members involved in the shoelace tightening region 10L. Further, by the configuration in which the lateral foot portion 100L and the medial foot portion 100M of the upper body 100 overlap with each other, formation of wrinkles in the upper body 100 by tightening the shoelace is suppressed. As a result, a feel of contact of the wearer's foot with the shoe and a fitted feel of the wearer's foot to the shoe are further improved. At this time, more specifically, the first extending portion 110 overlaps with the medial foot portion 100M while the second extending portion 120 overlaps with the lateral foot portion 100L.

The folded portion 220 is contiguous to at least one of a front end portion 211 and a rear end portion 212 of the first strip-shaped portion 210. In the present embodiment, the tape member 200 includes two folded portions 220. More specifically, the folded portion 220 includes a front-side folded portion 221 and a rear-side folded portion 222. The front-side folded portion 221 is contiguous to the front end portion 211 of the first strip-shaped portion 210. The rear-side folded portion 222 is contiguous to the rear end portion 212 of the first strip-shaped portion 210. In the following description of the present embodiment, when simply referred to as the "folded portion 220", the folded portion 220 may be understood as the front-side folded portion 221 or the rear-side folded portion 222.

The folded portion 220 is formed by folding the tape member 200 downward when viewed from the first strip-shaped portion 210 (see FIGS. 3 and 4). More specifically, the folded portion 220 is formed by folding the tape member 200 in the direction away from the shoelace tightening region 10L. The folded portion 220 is a portion where the tape member 200 is folded back on itself.

The second strip-shaped portion 230 extends downward from the folded portion 220. In the present embodiment, the tape member 200 includes two second strip-shaped portions 230. More specifically, the second strip-shaped portion 230 includes a front-side second strip-shaped portion 231 and a rear-side second strip-shaped portion 232. The front-side second strip-shaped portion 231 extends downward from the front-side folded portion 221. The rear-side second strip-shaped portion 232 extends downward from the rear-side folded portion 222. Thus, both the front-side second strip-shaped portion 231 and the rear-side second strip-shaped portion 232 for reinforcing the upper body 100 are provided by folding the tape member 200. Consequently, the processing of the reinforcing member and the configuration of this reinforcing member itself are simplified. Assuming that the length of the shoe 1 in the front-rear direction is defined as Lx, the front-side second strip-shaped portion 231 is provided, for example, at a distance of 0.6 Lx to 0.8 Lx from the rear end of the shoe 1. The rear-side second strip-shaped portion 232 is provided, for example, at a distance of 0.2 Lx to 0.5 Lx from the rear end of the shoe 1.

In the following description of the present embodiment, when simply referred to as the "second strip-shaped portion 230", the second strip-shaped portion 230 may be understood as the front-side second strip-shaped portion 231 or the rear-side second strip-shaped portion 232.

More specifically, the second strip-shaped portion 230 extends downward from the folded portion 220 and also extends to be inclined rearward. When viewed in the foot width direction, the rearward inclination angle of the rear-side second strip-shaped portion 232 is larger than that of the front-side second strip-shaped portion 231. Note that the inclination angle in this case is an angle formed by the extending direction of the second strip-shaped portion 230 and the up-down direction when viewed in the foot width direction. Further, the second strip-shaped portion 230 extends to reach the peripheral side surface 5S of the sole 5.

The second strip-shaped portion 230 is fixed to the upper body 100. Although the method of fixing the second strip-shaped portion 230 is not particularly limited, the second strip-shaped portion 230 is sewn onto the upper body 100 and thereby fixed in the present embodiment. Thus, by sewing the second strip-shaped portion 230 together with the first strip-shaped portion 210, the production efficiency is improved. Note that the second strip-shaped portion 230 may be fixed to the upper body 100 by a method other than sewing, for example, with an adhesive.

Figure 6:
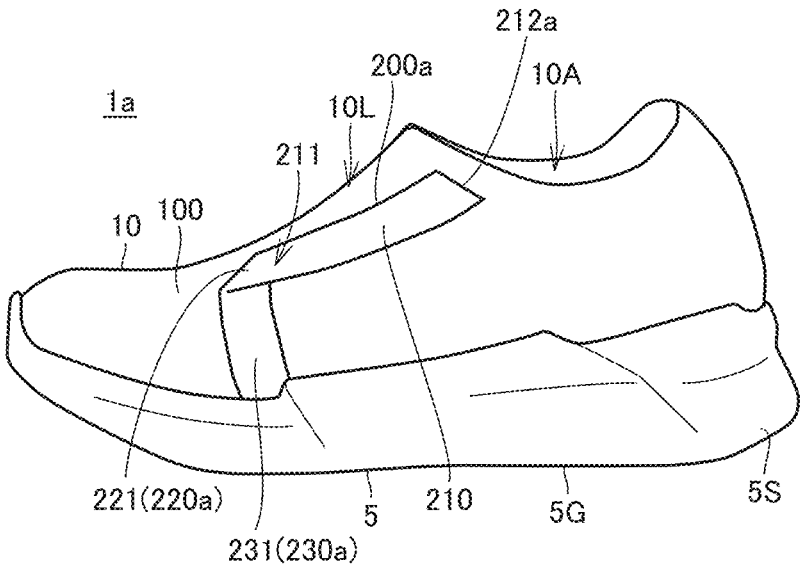
FIG. 6 is a side view schematically showing a shoe according to a first modification of the first embodiment of the present disclosure.

The configuration of the tape member 200 is not limited to the above-described configuration. FIG. 6 is a side view schematically showing a shoe according to the first modification of the first embodiment of the present disclosure. As shown in FIG. 6, in a shoe 1*a* according to the first modification of the first embodiment of the present disclosure, a folded portion 220*a* may be contiguous to only the front end portion 211 of the first strip-shaped portion 210. In other words, the folded portion 220*a* may be only the front-side folded portion 221. A rear end portion 212*a* of the first strip-shaped portion 210 may be an end portion of the entirety of a tape member 200*a*. A second strip-shaped portion 230*a* may be only the front-side second strip-shaped portion 231.

Figure 7:
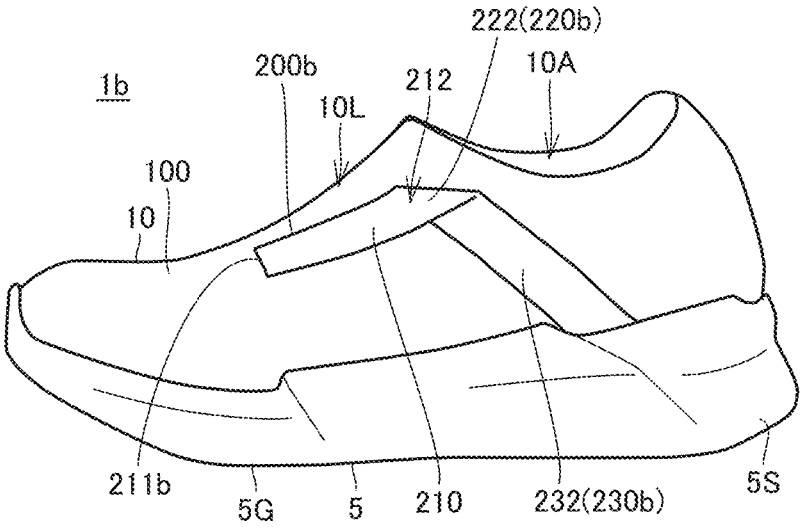
FIG. 7 is a side view schematically showing a shoe according to a second modification of the first embodiment of the present disclosure.

FIG. 7 is a side view schematically showing a shoe according to the second modification of the first embodiment of the present disclosure. As shown in FIG. 7, in a shoe 1*b* according to the second modification of the first embodiment of the present disclosure, a folded portion 220*b* may be contiguous to only the rear end portion 212 of the first strip-shaped portion 210. In other words, the folded portion 220*b* may be only the rear-side folded portion 222. A front end portion 211*b* of the first strip-shaped portion 210 may be an end portion of the entirety of a tape member 200*b*. A second strip-shaped portion 230*b* may be only the rear-side second strip-shaped portion 232.

Figure 8:
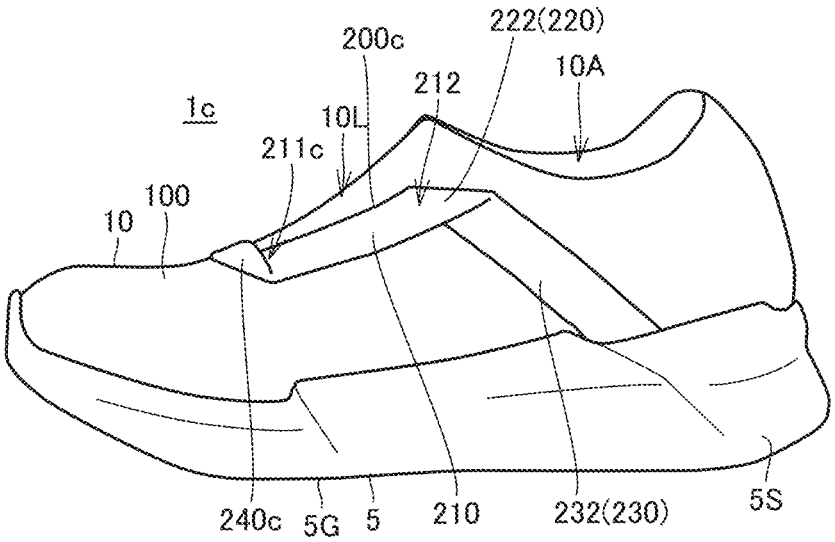
FIG. 8 is a side view schematically showing a shoe according to a third modification of the first embodiment of the present disclosure.
Figure 9:
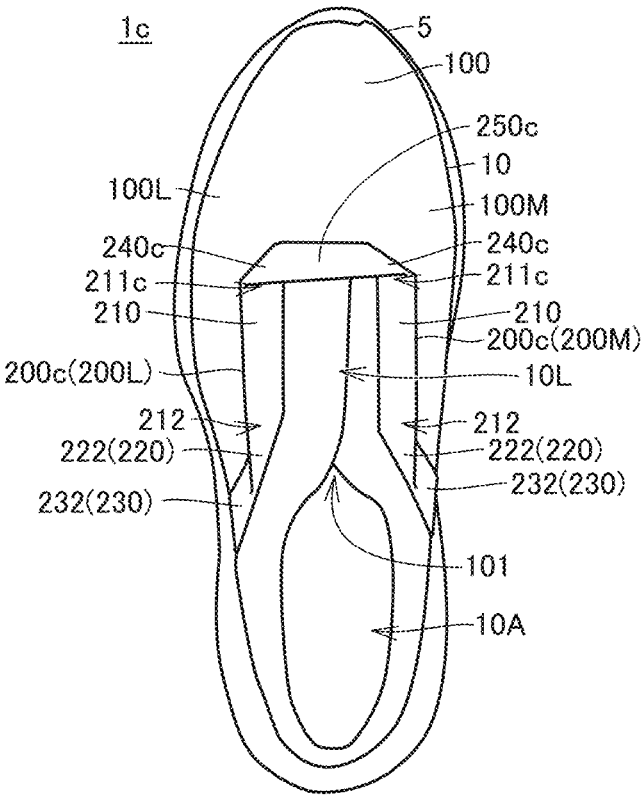
FIG. 9 is a plan view schematically showing the shoe according to the third modification of the first embodiment of the present disclosure.

FIG. 8 is a side view schematically showing a shoe according to the third modification of the first embodiment of the present disclosure. FIG. 9 is a plan view schematically showing the shoe according to the third modification of the first embodiment of the present disclosure. As shown in FIGS. 8 and 9, in a shoe 1*c* according to the third modification of the first embodiment of the present disclosure, a tape member 200*c* may further include a reverse folded portion 240*c* and a connected strip-shaped portion 250*c*. In the present modification, two reverse folded portions 240*c* may be located so as to respectively correspond to the lateral foot-side tape member 200L and the medial foot-side tape member 200M.

The reverse folded portion 240*c* may be contiguous to the front end portion 211*c* of the first strip-shaped portion 210. The reverse folded portion 240*c* may be formed by folding the tape member 200 upward when viewed from the first strip-shaped portion 210 (see FIG. 8). More specifically, the reverse folded portion 240*c* may be formed by folding the tape member 200*c* in the direction toward the center of the upper 10 in the foot width direction (see FIG. 9).

The connected strip-shaped portion 250*c* may extend from the reverse folded portion 240*c* in the foot width direction. The connected strip-shaped portion 250*c* may be connected to both the reverse folded portion 240*c* in the lateral foot-side tape member 200L and the reverse folded portion 240*c* in the medial foot-side tape member 200M. Thus, in the present modification, the lateral foot-side tape member 200L and the medial foot-side tape member 200M may be formed of a single contiguous tape member.

Further, as shown in FIGS. 1 to 5, in the present embodiment, the upper 10 further includes a sub-tape member 290. The sub-tape member 290 extends from an end portion of the rear-side second strip-shaped portion 232 in the lateral foot-side tape member 200L on the side opposite to the rear-side folded portion 222 to an end portion of the rear-side second strip-shaped portion 232 in the medial foot-side tape member 200M on the side opposite to the rear-side folded portion 222. Thereby, the lateral foot-side tape member 200L and the medial foot-side tape member 200M appear to be formed of a single tape member, so that the design of the shoe 1 is aesthetically improved.

Further, the sub-tape member 290 is located so as to extend along the rear side of the upper body 100. The sub-tape member 290 is located such that a part of the sub-tape member 290 is spaced apart from the upper body 100. Thereby, the wearer of the shoe 1 can wear the shoe 1 more easily by hooking the wearer's finger on the sub-tape member 290 while the wearer puts on the shoe 1.

The tape member 200 and the sub-tape member 290 may be formed of separate tape members. This eliminates the need to fold the tape member in the vicinity of the sole 5, and makes it possible to suppress the tape member from obstructing the joining between the sole 5 and the upper 10. Further, the tape member 200 may be formed of a single contiguous tape member. Thereby, the number of components constituting the shoe 1 can be reduced.

Then, the plurality of stitch portions 300 will be described. As shown in FIGS. 1 to 5, the plurality of stitch portions 300 are provided by sewing the first strip-shaped portion 210 onto the upper body 100 so as to provide the plurality of gaps G. The plurality of stitch portions 300 are arranged to be spaced apart from each other in an extending direction D1 of the first strip-shaped portion 210 (see FIGS. 1 and 2), and thereby, the shoelace L passing through the gaps G between the upper body 100 and the first strip-shaped portion 210 can be folded around each of the stitch portions 300 on the outer surface SA of the upper body 100 and can be engaged with each of the stitch portions 300.

According to the above-described configuration, when the wearer tightens the shoelace L, force is less likely to be applied in the direction in which the first strip-shaped portion 210 is peeled off from the upper body 100. Further, the stitch portions 300 engaged with the shoelace L pull the upper body 100 and the first strip-shaped portion 210 in the in-plane direction of the outer surface SA of the upper body 100. Thereby, the foot of the wearer of the shoe is tightened by the shoelace L along the outer surface SA, so that the foot of the wearer wearing the shoe can be more firmly supported.

Each of the plurality of stitch portions 300 is formed by sewing a string-like member forming the stitch portion 300 onto the upper body 100 and the tape member 200 (the first strip-shaped portion 210) in a zigzag pattern. The stitch portion 300 is what is called a zigzag stitch. Further, each of the plurality of stitch portions 300 is sewn in a zigzag pattern to cause the string-like members to overlap with each other, and thereby, the plurality of stitch portions 300 are firmly provided such that they can be engaged with the shoelace L.

Each of the plurality of stitch portions 300 extends in the direction substantially orthogonal to the extending direction D1 (see FIGS. 1 and 2). However, the extending direction of each of the plurality of stitch portions 300 may not be orthogonal to the extending direction D1 of the first strip-shaped portion 210. The number of the stitch portions 300 provided in one first strip-shaped portion 210 is adjusted as appropriate.

The size of each of the plurality of stitch portions 300 in the extending direction D1 is smaller than the separation distance between the plurality of stitch portions 300. In other words, in the present embodiment, the stitch width of each of the plurality of stitch portions 300 (the length of the entire stitch portions 300 in the short-side direction) is shorter than the separation distance between the plurality of stitch portions 300.

According to the above-described configuration, after inserting the shoelace L to pass through the gaps G and folding back the shoelace L at each stitch portion 300, a user can easily insert the shoelace L to pass between the plurality of stitch portions 300 spaced at a relatively large separation distance from each other. This makes it easier to tighten the foot of the wearer of the shoe by the shoelace L in the direction along the outer surface SA.

In the width direction of the first strip-shaped portion 210, each of the plurality of stitch portions 300 is located to entirely overlap with the first strip-shaped portion 210. Note that the width direction of the first strip-shaped portion 210 is orthogonal to the extending direction D1 and extends along the outer surface SA of the upper body 100.

In the present embodiment, the plurality of stitch portions 300 are configured such that, when the shoelace L is engaged with each stitch portion 300, at least a part of a folded portion L1 of the shoelace L is not located between the upper body 100 and the first strip-shaped portion 210. In other words, in a plan view of the shoe 1 as shown in FIG. 5, at least a part of the folded portion L1 of the shoelace L protrudes from the first strip-shaped portion 210. This configuration allows the user to easily pinch and hold the folded portion L1 of the shoelace L in each stitch portion 300, so that the user can easily adjust the tightening of the shoelace L. Specifically, the stitch length of each of the plurality of stitch portions 300 (the length of the entire stitch portions 300 in the long-side direction) is, for example, equal to or greater than about 80% and less than 100% of the dimension of the first strip-shaped portion 210 in the width direction.

Figure 10:
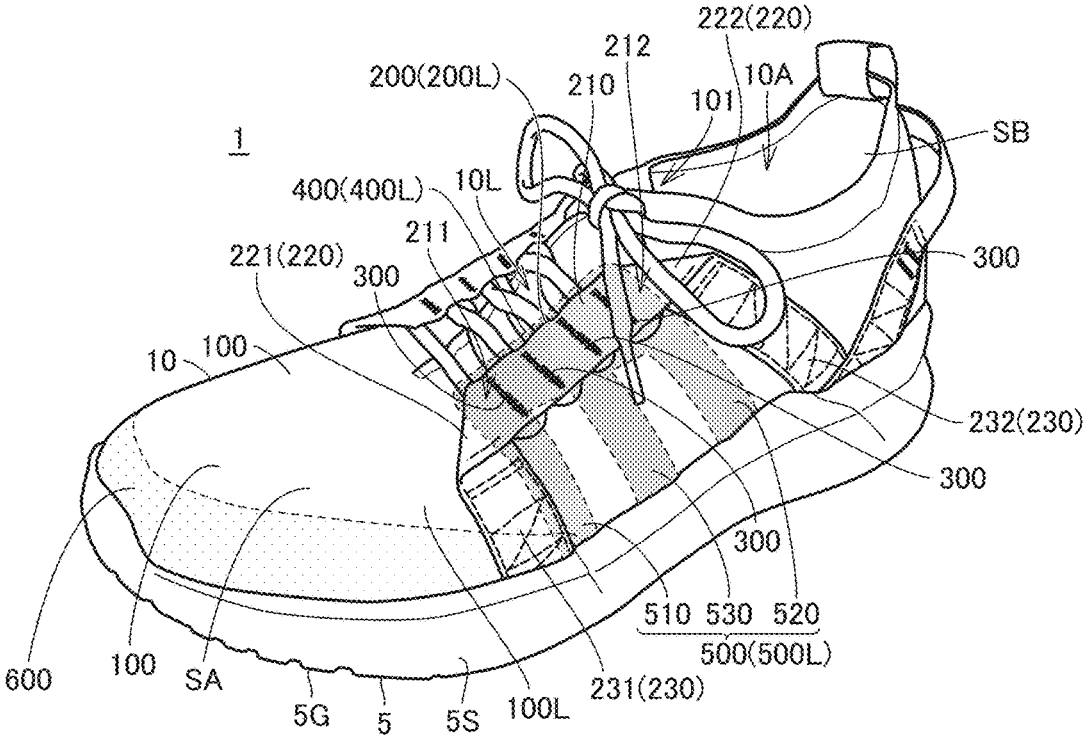
FIG. 10 is a perspective view of the shoe according to the first embodiment of the present disclosure, showing a configuration on an inner surface of the upper body when viewed from the lateral foot side.
Figure 11:
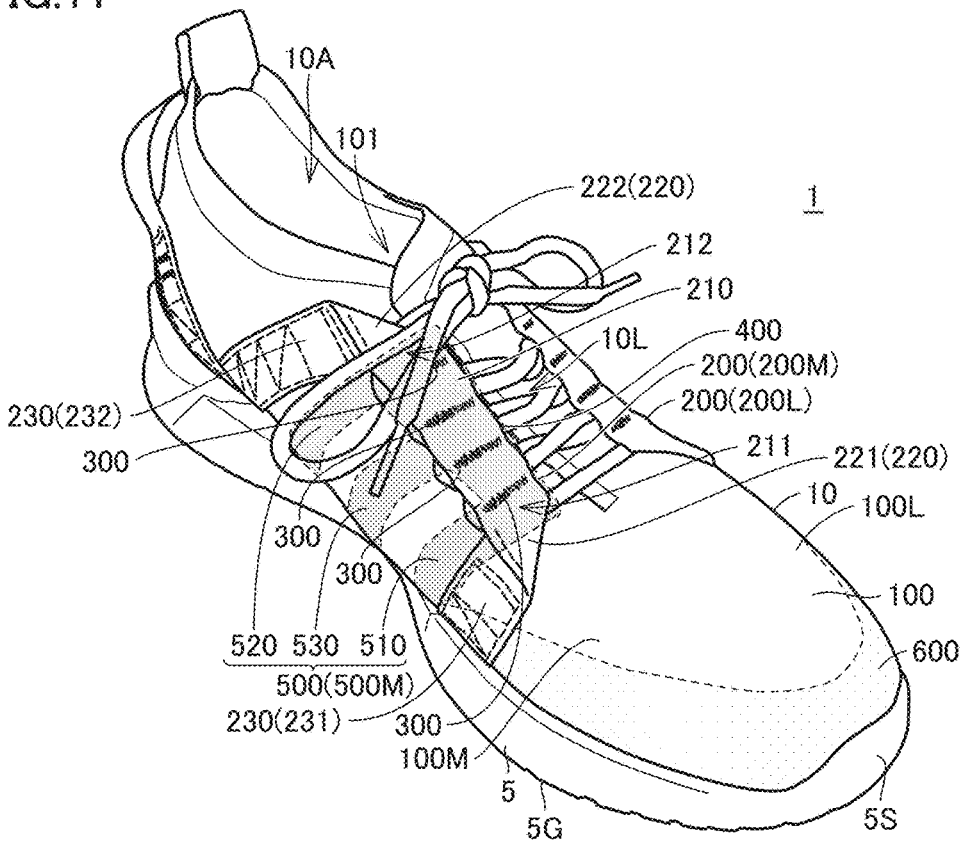
FIG. 11 is a perspective view of the shoe according to the first embodiment of the present disclosure, showing the configuration on the inner surface of the upper body when viewed from the medial foot side.
Figure 12:
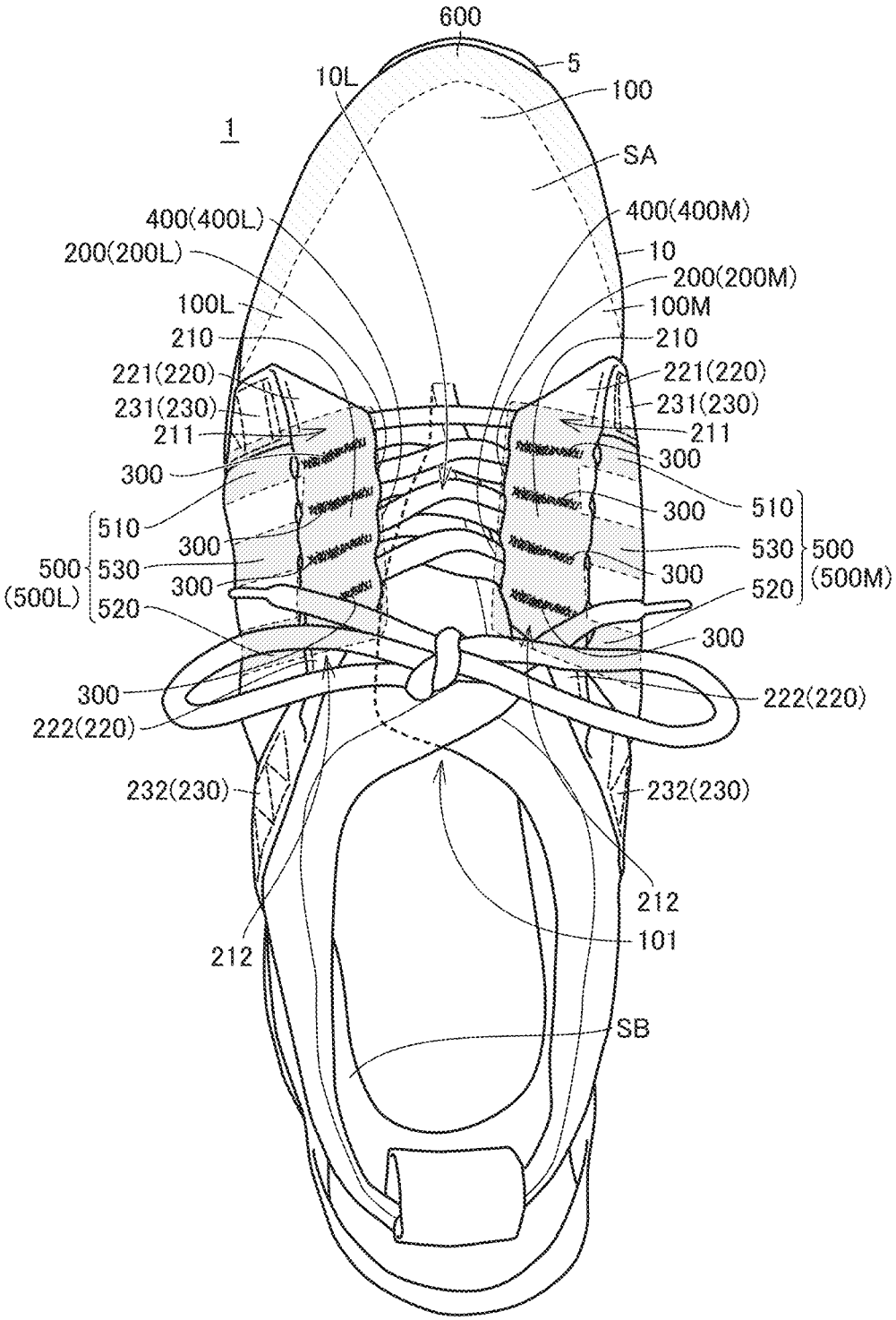
FIG. 12 is a plan view of the shoe according to the first embodiment of the present disclosure, showing the configuration on the inner surface of the upper body.

The following describes the configuration disposed on an inner surface SB of the upper body 100 in the present embodiment. FIG. 10 is a perspective view of the shoe according to the first embodiment of the present disclosure, showing a configuration on an inner surface of the upper body when viewed from the lateral foot side. FIG. 11 is a perspective view of the shoe according to the first embodiment of the present disclosure, showing the configuration on the inner surface of the upper body when viewed from the medial foot side. FIG. 12 is a plan view of the shoe according to the first embodiment of the present disclosure, showing the configuration on the inner surface of the upper body.

As shown in FIGS. 10 to 12, the upper 10 further includes a first reinforcing portion 400, a second reinforcing portion 500, and a third reinforcing portion 600. In FIGS. 10 to 12, the first reinforcing portion 400 and the second reinforcing portion 500 located on the inner surface SB of the upper body 100 are schematically shown in a relatively densely dotted pattern. Further, the third reinforcing portion 600 located on the inner surface SB of the upper body 100 is shown in a relatively less densely dotted pattern.

In the present embodiment, the upper 10 includes two first reinforcing portions 400 and two second reinforcing portions 500.

The two first reinforcing portions 400 include a lateral foot-side first reinforcing portion 400L located on the lateral foot side and a medial foot-side first reinforcing portion 400M located on the medial foot side. Hereinafter, when simply referred to as the "first reinforcing portion 400", the first reinforcing portion 400 may be understood as the lateral foot-side first reinforcing portion 400L or the medial foot-side first reinforcing portion 400M.

The two second reinforcing portions 500 include a lateral foot-side second reinforcing portion 500L located on the lateral foot side and a medial foot-side second reinforcing portion 500M located on the medial foot side. Hereinafter, when simply referred to as the "second reinforcing portion 500", the second reinforcing portion 500 may be understood as the lateral foot-side second reinforcing portion 500L or the medial foot-side second reinforcing portion 500M.

The first reinforcing portion 400 is higher in rigidity than the upper body 100. Further, the first reinforcing portion 400 is located on the inner surface SB of the upper body 100 so as to sandwich the upper body 100 between the first reinforcing portion 400 and the first strip-shaped portion 210. More specifically, together with the first strip-shaped portion 210, the first reinforcing portion 400 is sewn onto the upper body 100. Thereby, even when the rigidity of the upper body 100 is relatively low, excessive stretching of the upper body 100 can be suppressed, and the first strip-shaped portion 210 can be firmly attached to the upper body 100.

From the viewpoint of recyclability, the first reinforcing portion 400 is preferably made of a resin composition containing a polyester resin as a main component. The first reinforcing portion 400 is formed of a sheet-like member. The first reinforcing portion 400 is smaller in thickness than the tape member 200. Thereby, the first reinforcing portion 400 can reinforce the upper 10 while suppressing obstruction to the wearer's fitted feel to the upper 10.

Further, the first reinforcing portion 400 is entirely joined with an adhesive onto the inner surface SB of the upper body 100. The first reinforcing portion 400 extends in the extending direction of the first strip-shaped portion 210. The first reinforcing portion 400 is located so as to substantially overlap with the first strip-shaped portion 210 when viewed in the thickness direction of the upper body 100. Note that the first reinforcing portion 400 is configured to be increased in width dimension toward the rear side.

The second reinforcing portion 500 is higher in rigidity than the upper body 100. The second reinforcing portion 500 is fixed to a region of the upper body 100 between a portion to which the front-side second strip-shaped portion 231 is fixed and a portion to which the rear-side second strip-shaped portion 232 is fixed. The second reinforcing portion 500 extends in the up-down direction along the upper body 100. Thereby, the region of the upper body 100 that is surrounded by the front-side first strip-shaped portion 210, the front-side second strip-shaped portion 231, and the rear-side second strip-shaped portion 232 in a view of the upper 10 from the outer surface SA side can be suppressed from excessively stretching in the direction along the outer surface SA of the upper body 100 by tightening of the shoelace L. Note that the second reinforcing portion 500 extends to reach the peripheral side surface 5S of the sole 5.

The second reinforcing portion 500 includes a front-side second reinforcing portion 510, a rear-side second reinforcing portion 520, and at least one central second reinforcing portion 530. The front-side second reinforcing portion 510 is located at the foremost position in the second reinforcing portion 500.

The rear-side second reinforcing portion 520 is located at the rearmost position in the second reinforcing portion 500. The rear-side second reinforcing portion 520 is spaced apart from the front-side second reinforcing portion 510. Thereby, in the region surrounded by the front-side first strip-shaped portion 210, the front-side second strip-shaped portion 231, and the rear-side second strip-shaped portion 232, stretching of the upper body 100 is not excessively suppressed, which makes it possible to suppress lowering of the wearer's fitted feel to the region.

The central second reinforcing portion 530 is located between the front-side second reinforcing portion 510 and the rear-side second reinforcing portion 520. The central second reinforcing portion 530 is spaced apart from both the front-side second reinforcing portion 510 and the rear-side second reinforcing portion 520. Thereby, in the region surrounded by the front-side first strip-shaped portion 210, the front-side second strip-shaped portion 231, and the rear-side second strip-shaped portion 232, stretching of the upper body 100 and lowering of the fitted feel to this region can be more appropriately suppressed.

From the viewpoint of recyclability, the second reinforcing portion 500 is preferably made of a resin composition containing a polyester resin as a main component. The second reinforcing portion 500 is formed of a sheet-like member. The second reinforcing portion 500 is smaller in thickness than the tape member 200. Thereby, the second reinforcing portion 500 can reinforce the upper 10 while suppressing obstruction to the wearer's fitted feel to the upper 10.

In the present embodiment, the second reinforcing portion 500 is located on the inner surface SB of the upper body 100. The second reinforcing portion 500 is connected to the first reinforcing portion 400. The second reinforcing portion 500 is formed of a single member together with the first reinforcing portion 400. Since the first reinforcing portion 400 is formed of a single member together with the second reinforcing portion 500, the processing of the member of the reinforcing portion and the configuration of this member are simplified. Consequently, the production efficiency of the shoe 1 can be improved.

More specifically, the front-side second reinforcing portion 510 extends downward from the front end of the first reinforcing portion 400 along the front-side second strip-shaped portion 231. The rear-side second reinforcing portion 520 extends downward from the rear end of the first reinforcing portion 400 so as to be substantially parallel to the first reinforcing portion 400. The central second reinforcing portion 530 extends downward from substantially the center of the first reinforcing portion 400 so as to be parallel to each of the front-side second reinforcing portion 510 and the rear-side second reinforcing portion 520.

The configuration of the second reinforcing portion 500 is not limited to the above-described configuration. The front-side second reinforcing portion 510, the rear-side second reinforcing portion 520, and the central second reinforcing portion 530 may not be separated from each other but may be contiguous to each other. The second reinforcing portion 500 may include a plurality of central second reinforcing portions 530 spaced apart from each other.

The third reinforcing portion 600 is located on the inner surface SB of the upper body 100. Further, the third reinforcing portion 600 is higher in rigidity than the upper body 100 and is located forward of at least the tape member 200 (specifically, the front-side second strip-shaped portion 231). Thereby, when the wearer wears the shoe 1, the upper body 100 having relatively low rigidity can be suppressed from excessively stretching also in a region located forward of the tape member 200.

More specifically, the third reinforcing portion 600 is disposed in a portion of the upper body 100 that is in contact with the sole 5. The third reinforcing portion 600 extends along the peripheral side surface 5S of the sole 5. The third reinforcing portion 600 extends from the lateral foot-side second reinforcing portion 500L to the medial foot-side second reinforcing portion 500M.

As described above, the shoe 1 according to the first embodiment of the present disclosure includes the sole 5 and the upper 10. The upper 10 is located above the sole 5, has the opening 10A through which a wearer's foot is inserted when the wearer puts on the shoe 1, and includes the shoelace tightening region 10L located forward of the opening 10A. The upper 10 includes the upper body 100 and the tape member 200 having a tape shape. The upper body 100 is capable of, together with the sole 5, accommodating the wearer's foot. The tape member 200 is sewn onto the outer surface SA of the upper body 100. The tape member 200 is higher in rigidity than the upper body 100. The tape member 200 includes the first strip-shaped portion 210, the folded portion 220, and the second strip-shaped portion 230. The first strip-shaped portion 210 is located in the shoelace tightening region 10L and extends in the front-rear direction of the upper 10. The folded portion 220 is contiguous to at least one of the front end portion 211 and the rear end portion 212 of the first strip-shaped portion 210. The folded portion 220 is formed by folding the tape member 200 downward when viewed from the first strip-shaped portion 210. The second strip-shaped portion 230 extends downward from the folded portion 220. The first strip-shaped portion 210 is sewn onto the upper body 100 such that the plurality of gaps G through which the shoelace L passes are provided between the first strip-shaped portion 210 and the upper body 100.

According to the above-described configuration, the first strip-shaped portion 210 and the second strip-shaped portion 230 for reinforcing the upper body 100 are provided by folding the tape member 200. Thus, the processing of the reinforcing member and the configuration of the member itself are simplified. Further, the plurality of gaps G through which the shoelace L passes are provided by sewing the first strip-shaped portion 210 onto the upper body 100. Thus, the processing of the first strip-shaped portion 210 and the configuration through which the shoelace L passes are simplified. Therefore, the above-described configuration makes it possible to improve the production efficiency of the shoe including the upper body 100 having a surface on which a reinforcing member is disposed.

[Method of Manufacturing Shoe]

Figure 13:
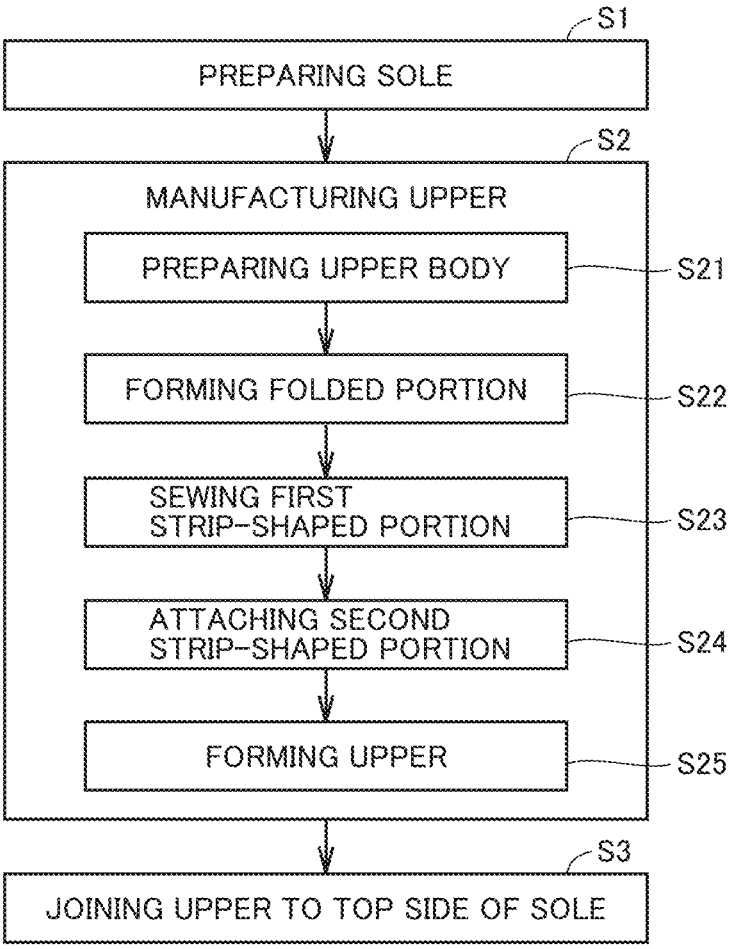
FIG. 13 is a flowchart showing a method of manufacturing the shoe according to the first embodiment of the present disclosure.

The following describes a method of manufacturing the shoe 1 according to the first embodiment of the present disclosure. FIG. 13 is a flowchart showing a method of manufacturing the shoe according to the first embodiment of the present disclosure. As shown in FIG. 13, the method of manufacturing the shoe according to the first embodiment of the present disclosure includes: a step S1 of preparing a sole; a step S2 of manufacturing an upper; and a step S3 of joining the upper to a top side of the sole.

The step S2 of manufacturing an upper includes: a step S21 of preparing an upper body; a step S22 of forming a folded portion; a step S23 of sewing a first strip-shaped portion; a step S24 of attaching a second strip-shaped portion; and a step S25 of forming an upper.

In the step S21 of preparing an upper body, specifically, a plurality of flat members each made of a knitted fabric for forming the upper body 100 are prepared. Thus, in the process of preparing the upper body 100, an outer-shape molding step such as die cutting can also be omitted. Consequently, the production efficiency of the shoe 1 can be improved. Further, when prescribed reinforcing members (for example, the first reinforcing portion 400, the second reinforcing portion 500, the third reinforcing portion 600, and the like) are provided on the inner surface SB of the upper body 100, these reinforcing members are bonded to the above-mentioned members with an adhesive or the like.

Figure 14:
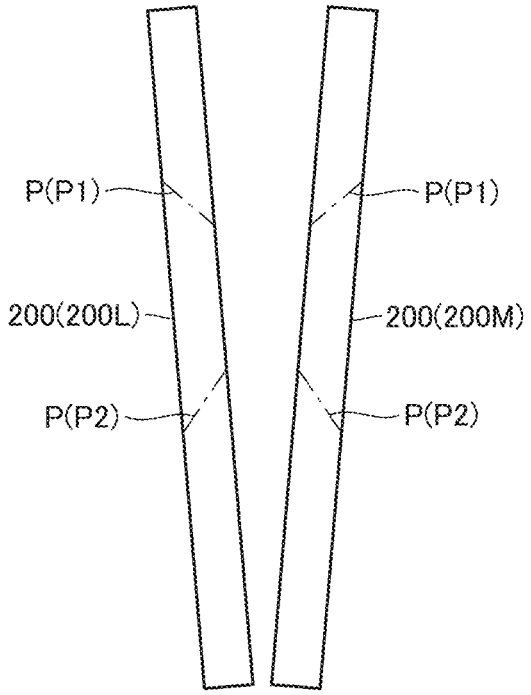
FIG. 14 is a plan view showing a tape member before it is folded in the method of manufacturing the shoe according to the first embodiment of the present disclosure.
Figure 15:
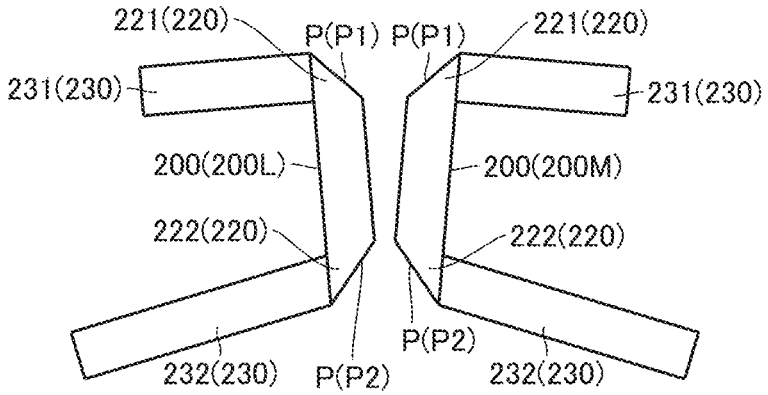
FIG. 15 is a plan view showing the tape member immediately after it is folded in the method of manufacturing the shoe according to the first embodiment of the present disclosure.

FIG. 14 is a plan view showing a tape member before it is folded in the method of manufacturing the shoe according to the first embodiment of the present disclosure. FIG. 15 is a plan view showing the tape member immediately after it is folded in the method of manufacturing the shoe according to the first embodiment of the present disclosure. As shown in FIGS. 14 and 15, in the step S22 of forming a folded portion, the tape member 200 having a tape shape and higher in rigidity than the upper body 100 is folded along a fold portion P, and thereby, the folded portion 220 is formed. In the present embodiment, the tape member is folded along a first fold portion P1 and a second fold portion P2 as a plurality of fold portions P. Thereby, the front-side folded portion 221 and the rear-side folded portion 222 are formed.

In the step S22 of forming a folded portion, the tape member 200 folded along the fold portion P as described above may be further heated and compressed with a hot press machine. Thereby, the outer shape of the folded portion 220 is maintained with stability. Consequently, in a subsequent step, the first strip-shaped portion 210 and the second strip-shaped portion 230 can be easily sewn onto the upper body 100. The above-mentioned compression may be performed several times.

Further, in the step S22 of forming a folded portion, the portions of the tape member 200 that overlap with each other in the folded portion 220 may be sewn together as temporary sewing. Thereby, the outer shape of the folded portion 220 is maintained with stability. Consequently, in a subsequent step, the first strip-shaped portion 210 and the second strip-shaped portion 230 can be easily sewn onto the upper body 100.

In the step S23 of sewing the first strip-shaped portion, the first strip-shaped portion 210 as a portion on one side of the tape member 200 when viewed from the folded portion 220 is sewn onto the outer surface SA of the upper body 100 (specifically, a plurality of flat members each made of a knitted fabric) so as to be located in the shoelace tightening region 10L and to extend in the front-rear direction of the upper 10. The first strip-shaped portion 210 is sewn onto the upper body 100 such that a plurality of gaps G through which the shoelace L passes are provided between the first strip-shaped portion 210 and the upper body 100. A plurality of stitch portions 300 are formed by the step S23 of sewing the first strip-shaped portion.

In the step S24 of attaching the second strip-shaped portion, the second strip-shaped portion 230 as a portion on the other side of the tape member 200 when viewed from the folded portion 220 is attached to the outer surface SA of the upper body 100 (specifically, a plurality of flat members each made of a knitted fabric) so as to extend downward from the folded portion 220. In the present embodiment, the second strip-shaped portion 230 is sewn onto the upper body 100 and thereby attached to the upper body 100.

The order of the step S23 of sewing the first strip-shaped portion and the step S24 of attaching the second strip-shaped portion is not particularly limited. In other words, the step S23 of sewing the first strip-shaped portion may be performed after the step S24 of attaching the second strip-shaped portion, or the step S23 of sewing the first strip-shaped portion and the step S24 of attaching the second strip-shaped portion may be performed simultaneously in parallel.

In the step S25 of forming the upper, in the state in which the tape member 200 is sewn and attached onto the plurality of flat members each made of a knitted fabric and prepared as members for forming the upper body, the plurality of flat members are covered over a last, and the edges of these members are sewn together along prescribed portions. Thereby, the upper 10 according to the present embodiment is manufactured.

Finally, in the step S3, the upper 10 is joined to the top side of the sole 5. The joining method is not particularly limited. As a method of joining the upper 10 to the top side of the sole 5, a conventionally known method may be adopted. In this way, the shoe according to the first embodiment of the present disclosure is manufactured.

As described above, the method of manufacturing the shoe according to the first embodiment of the present disclosure includes: the step S1 of preparing the sole 5; the step S2 of manufacturing the upper 10 having the opening 10A through which the wearer's foot is inserted when the wearer puts on the shoe, and including the shoelace tightening region 10L located forward of the opening 10A; and the step S3 of joining the upper 10 to the top side of the sole 5. The step S2 of manufacturing the upper 10 includes: the step S21 of preparing the upper body 100 capable of, together with the sole 5, accommodating the wearer's foot; the step S22 of forming the folded portion 220 by folding the tape-shaped tape member 200 higher in rigidity than the upper body 100 along the fold portion P; the step S23 of sewing the first strip-shaped portion 210 of the tape member 200 onto the outer surface SA of the upper body 100 so as to be located in the shoelace tightening region 10L and to extend in the front-rear direction of the upper 10, the first strip-shaped portion 210 being a portion on one side in the tape member 200 when viewed from the folded portion 220; and a step S24 of attaching the second strip-shaped portion 230 to the outer surface SA of the upper body 100 so as to extend downward from the folded portion 220, the second strip-shaped portion 230 being a portion on the other side in the tape member 200 when viewed from the folded portion 220. The first strip-shaped portion 210 is sewn onto the upper body 100 such that a plurality of gaps G through which the shoelace L passes are provided between the first strip-shaped portion 210 and the upper body 100.

According to the above-described configuration, the first strip-shaped portion 210 and the second strip-shaped portion 230 for reinforcing the upper body 100 are provided by folding the tape member 200. Thus, the processing of the reinforcing member and the configuration of this member itself are simplified. Further, the plurality of gaps G through which the shoelace L passes are provided by sewing the first strip-shaped portion 210 onto the upper body 100. Thus, the processing of the first strip-shaped portion 210 and the configuration through which the shoelace L passes are simplified. Therefore, the above-described configuration makes it possible to provide a method of manufacturing the shoe that includes the upper body 100 with a surface having the reinforcing member disposed thereon and that is improved in production efficiency.

Second Embodiment

The following describes a shoe according to the second embodiment of the present disclosure. The shoe according to the second embodiment of the present disclosure is different in configuration of the stitch portion from the shoe 1 according to the first embodiment of the present disclosure. Thus, the description of the same configurations as those in the first embodiment of the present disclosure will not be repeated.

Figure 16:
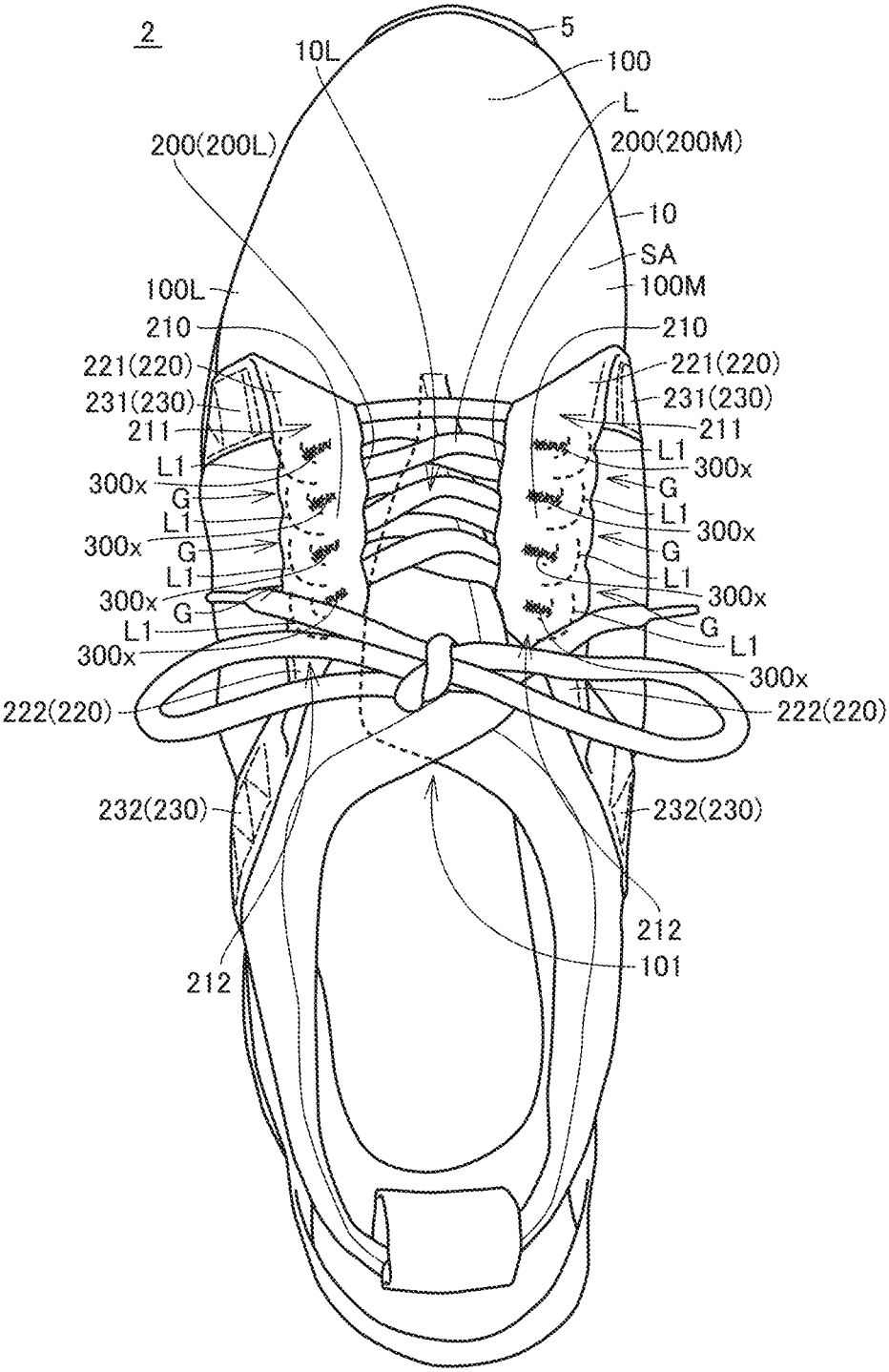
FIG. 16 is a plan view showing a shoe according to a second embodiment of the present disclosure.

FIG. 16 is a plan view showing a shoe according to the second embodiment of the present disclosure. The folded portion L1 of the shoelace L cannot be actually seen from above, but FIG. 16 shows the folded portion L1 by a broken line for convenience of description. As shown in FIG. 16, in a shoe 2 according to the second embodiment of the present disclosure, a plurality of stitch portions 300*x* are configured such that, when the shoelace L is engaged with each of the stitch portions 300*x*, the folded portion L1 of the shoelace L is entirely located between the upper body 100 and the first strip-shaped portion 210. The plurality of stitch portions 300*x* configured in this manner serve to reduce the opportunity in which the folded portion L1 of the shoelace L in each stitch portion 300*x* wears away by contact with other external components or the like.

Specifically, the stitch length of each of the plurality of stitch portions 300*x* is, for example, equal to or greater than about 25% and less than about 50% of the dimension of the first strip-shaped portion 210 in the width direction.

SUPPLEMENTARY NOTES

As described above, the embodiments of the present disclosure include the following disclosure.

A shoe according to the first aspect of the present disclosure includes:

a sole (5); and an upper (10) located above the sole (5), having an opening (10A) through which a foot of a wearer is inserted when the wearer puts on the shoe, and including a shoelace tightening region (10L) located forward of the opening (10A), wherein the upper (10) includes an upper body (100) capable of, together with the sole (5), accommodating the foot of the wearer, and a tape member (200) having a tape shape and being higher in rigidity than the upper body (100), the tape member (200) being sewn onto an outer surface (SA) of the upper body (100), the tape member (200) includes a first strip-shaped portion (210) located in the shoelace tightening region (10L) and extending in a front-rear direction of the upper (10), a folded portion (220) contiguous to at least one of a front end portion (211) and a rear end portion (212) of the first strip-shaped portion (210) and formed by folding the tape member (200) downward when viewed from the first strip-shaped portion (210), and a second strip-shaped portion (230) extending downward from the folded portion (220), and the first strip-shaped portion (210) is sewn onto the upper body (100) such that a plurality of gaps (G) through which a shoelace (L) passes are provided between the first strip-shaped portion (210) and the upper body (100).

A shoe according to the second aspect of the present disclosure is the shoe according to the first aspect, wherein the folded portion (220) includes a front-side folded portion (221) contiguous to the front end portion (211) of the first strip-shaped portion (210), and a rear-side folded portion (222) contiguous to the rear end portion (212) of the first strip-shaped portion (210), and the second strip-shaped portion (230) includes a front-side second strip-shaped portion (231) extending downward from the front-side folded portion (221), and a rear-side second strip-shaped portion (232) extending downward from the rear-side folded portion (222).

A shoe according to the third aspect of the present disclosure is the shoe according to the first or second aspect, wherein the upper (10) further includes a plurality of stitch portions (300) provided by sewing the first strip-shaped portion (210) onto the upper body (100) to provide the gaps (G), and the stitch portions (300) are arranged to be spaced apart from each other in an extending direction (D1) of the first strip-shaped portion (210) such that the shoelace (L) passing through the gaps (G) between the upper body (100) and the first strip-shaped portion (210) can be folded around each of the stitch portions (300) on the outer surface (SA) of the upper body (100) and engaged with each of the stitch portions (300).

A shoe according to the fourth aspect of the present disclosure is the shoe according to the third aspect, wherein a size of each of the stitch portions (300) in the extending direction (D1) is smaller than a separation distance between the stitch portions (300).

A shoe according to the fifth aspect of the present disclosure is the shoe according to the third or fourth aspect, wherein each of the stitch portions (300) is located to entirely overlap with the first strip-shaped portion (210) in a width direction of the first strip-shaped portion (210), the width direction being orthogonal to the extending direction (D1) and extending along the outer surface (SA) of the upper body (100), and the stitch portions (300) are configured such that, when the shoelace (L) is engaged with each of the stitch portions (300), at least a part of a folded portion (L1) of the shoelace (L) is not located between the upper body (100) and the first strip-shaped portion (210).

A shoe according to the sixth aspect of the present disclosure is the shoe according to the third or fourth aspect, wherein each of the stitch portions (300*x*) is located to entirely overlap with the first strip-shaped portion (210) in a width direction of the first strip-shaped portion (210), the width direction being orthogonal to the extending direction (D1) and extending along the outer surface (SA) of the upper body (100), and the stitch portions (300*x*) are configured such that, when the shoelace (L) is engaged with each of the stitch portions (300*x*), a folded portion (L1) of the shoelace (L) is entirely located between the upper body (100) and the first strip-shaped portion (210).

A shoe according to the seventh aspect of the present disclosure is the shoe according to any one of the first to sixth aspects, wherein the upper (10) further includes a first reinforcing portion (400) higher in rigidity than the upper body (100), the first reinforcing portion (400) being located on an inner surface (SB) of the upper body (100) so as to sandwich the upper body (100) between the first reinforcing portion (400) and the first strip-shaped portion (210), and together with the first strip-shaped portion (210), the first reinforcing portion (400) is sewn onto the upper body (100).

A shoe according to the eighth aspect of the present disclosure is the shoe according to the second aspect, wherein the upper (10) further includes a second reinforcing portion (500) higher in rigidity than the upper body (100), the second reinforcing portion (500) being fixed to a region of the upper body (100) between a portion to which the front-side second strip-shaped portion (231) is fixed and a portion to which the rear-side second strip-shaped portion (232) is fixed, and the second reinforcing portion (500) extending in an up-down direction along the upper body (100).

A shoe according to the ninth aspect of the present disclosure is the shoe according to the eighth aspect, wherein the upper (10) further includes a first reinforcing portion (400) higher in rigidity than the upper body (100), the first reinforcing portion (400) being located on an inner surface (SB) of the upper body (100) so as to sandwich the upper body (100) between the first reinforcing portion (400) and the first strip-shaped portion (210), together with the first strip-shaped portion (210), the first reinforcing portion (400) is sewn onto the upper body (100), and the second reinforcing portion (500) is located on the inner surface (SB) of the upper body (100), connected to the first reinforcing portion (400), and formed of a single member together with the first reinforcing portion (400).

A shoe according to the tenth aspect of the present disclosure is the shoe according to any one of the first to ninth aspects, wherein the tape member (200) includes a lateral foot-side tape member (200L) attached to the outer surface (SA) of the upper body (100) on a lateral foot side, and a medial foot-side tape member (200M) attached to the outer surface (SA) of the upper body (100) on a medial foot side.

A shoe according to the eleventh aspect of the present disclosure is the shoe according to any one of the first to tenth aspects, wherein the upper body (100) is formed of a lateral foot portion (100L) located on a lateral foot side, and a medial foot portion (100M) located on a medial foot side and connected to the lateral foot portion (100L), the upper body (100) has a slit (101) located in the shoelace tightening region (10L) and extending forward from the opening (10A) such that the lateral foot portion (100L) and the medial foot portion (100M) are separated from each other, and the lateral foot portion (100L) and the medial foot portion (100M) are configured in such a manner that the lateral foot portion (100L) and the medial foot portion (100M) located on both sides of the slit (101) in a foot width direction overlap with each other by tightening the shoelace (L) passing through the gaps (G) between the first strip-shaped portion (210) and the upper body (100).

A shoe according to the twelfth aspect of the present disclosure is the shoe according to any one of the first to eleventh aspects, wherein the upper body (100) is formed of a knitted fabric.

A method of manufacturing a shoe according to the thirteenth aspect of the present disclosure includes:

(S1) preparing a sole (5);

(S2) manufacturing an upper (10) having an opening (10A) through which a foot of a wearer is inserted when the wearer puts on the shoe, and including a shoelace tightening region (10L) located forward of the opening (10A); and (S3) joining the upper (10) to a top side of the sole (5), wherein the (S2) manufacturing an upper includes (S21) preparing an upper body (100) capable of, together with the sole (5), accommodating the foot of the wearer, (S22) forming a folded portion (220) by folding a tape member (200) having a tape shape along a fold portion (P), the tape member (200) being higher in rigidity than the upper body (100), (S23) sewing a first strip-shaped portion (210) of the tape member (200) onto an outer surface (SA) of the upper body (100) so as to be located in the shoelace tightening region (10L) and to extend in a front-rear direction of the upper (10), the first strip-shaped portion (210) being a portion on one side in the tape member (200) when viewed from the folded portion (220), and (S24) attaching a second strip-shaped portion (230) of the tape member (200) to the outer surface (SA) of the upper body (100) so as to extend downward from the folded portion (220), the second strip-shaped portion (230) being a portion on the other side in the tape member (200) when viewed from the folded portion (220), and the first strip-shaped portion (210) is sewn onto the upper body (100) such that a plurality of gaps (G) through which a shoelace (L) passes are provided between the first strip-shaped portion (210) and the upper body (100).

In the above-described embodiments, configurations that can be combined with each other may be combined as appropriate.

Although the embodiments of the present invention have been described as above, it should be understood that the embodiments disclosed herein are illustrative and non-restrictive in every respect. The scope of the present invention is defined by the terms of the claims and is intended to include any modifications within the meaning and scope equivalent to the terms of the claims.

What is claimed is:

1. A shoe comprising:

a sole; and an upper located above the sole and having an opening through which a foot of a wearer is inserted when the wearer puts on the shoe, and a shoelace tightening region located forward of the opening, wherein the upper further includes:

an upper body configured to, together with the sole, accommodate the foot of the wearer; and a tape member having a generally rectangular shape and being higher in rigidity than the upper body, the tape member being sewn onto an outer surface of the upper body, wherein the tape member includes:

a first portion located in the shoelace tightening region and extending in a front-rear direction of the upper, a front-side folded portion contiguous to a front end portion and a rear-side folded portion contiguous to a rear end portion of the first portion, each of the front-side and rear-side folded portions being formed by folding the tape member downward when viewed from the first portion, a front-side second portion extending downward from the front-side folded portion to a peripheral side surface of the sole, a rear-side second portion extending downward from the rear-side folded portion to the peripheral side surface of the sole, and wherein the first portion is sewn onto the upper body such that a plurality of gaps through which a shoelace passes are provided between the first portion and the upper body, and wherein the first portion of the tape member does not include any folds.

2. The shoe according to claim 1, wherein the front-side second portion and rear-side second portion are inclined rearward when viewed in a width direction of the upper and, wherein the rear-side second portion has a larger rearward inclination angle than that of the front-side second portion.

3. The shoe according to claim 1, wherein the upper further includes a plurality of stitch portions provided by sewing the first portion onto the upper body to provide the gaps, and the stitch portions are arranged to be spaced apart from each other in an extending direction of the first portion such that the shoelace passing through the gaps between the upper body and the first portion can be folded around each of the stitch portions on the outer surface of the upper body and engaged with each of the stitch portions.

4. The shoe according to claim 3, wherein a size of each of the stitch portions in the extending direction is smaller than a separation distance between the stitch portions.

5. The shoe according to claim 3, wherein each of the stitch portions is located to entirely overlap with the first portion in a width direction of the first portion, the width direction being orthogonal to the extending direction and extending along the outer surface of the upper body, and wherein the stitch portions are configured such that, when the shoelace is engaged with each of the stitch portions, at least a part of a folded portion of the shoelace is not located between the upper body and the first portion.

6. The shoe according to claim 3, wherein each of the stitch portions is located to entirely overlap with the first portion in a width direction of the first portion, the width direction being orthogonal to the extending direction and extending along the outer surface of the upper body, and wherein the stitch portions are configured such that, when the shoelace is engaged with each of the stitch portions, a folded portion of the shoelace is entirely located between the upper body and the first portion.

7. The shoe according to claim 1, wherein the upper further includes a first reinforcing portion higher in rigidity than the upper body, the first reinforcing portion being located on an inner surface of the upper body so as to sandwich the upper body between the first reinforcing portion and the first portion, and wherein together with the first portion, the first reinforcing portion is sewn onto the upper body.

8. The shoe according to claim 7, wherein the upper further includes a second reinforcing portion higher in rigidity than the upper body, the second reinforcing portion being fixed to a region of the upper body between a portion to which the front-side second portion is fixed and a portion to which the rear-side second portion is fixed, and the second reinforcing portion extending in an up-down direction along the upper body.

9. The shoe according to claim 8, wherein the second reinforcing portion is located on the inner surface of the upper body, connected to the first reinforcing portion, and formed of a single member together with the first reinforcing portion.

10. The shoe according to claim 1, wherein the tape member is a lateral foot-side tape member attached to the outer surface of the upper body on a lateral foot side, and the shoe further includes a medial foot-side tape member substantially the same as the lateral foot-side tape member and attached to the outer surface of the upper body on a medial foot side, wherein the lateral foot-side tape member and medial foot-side tape members are formed of separate contiguous tape members.

11. The shoe according to claim 1, wherein the upper body includes:

a lateral foot portion located on a lateral foot side, and a medial foot portion located on a medial foot side and connected to the lateral foot portion, wherein the upper body has a slit located in the shoelace tightening region and extending forward from the opening such that the lateral foot portion and the medial foot portion are separated from each other, and wherein the lateral foot portion and the medial foot portion are configured in such a manner that the lateral foot portion and the medial foot portion located on both sides of the slit in a foot width direction overlap with each other by tightening the shoelace passing through the gaps between the first portion and the upper body.

12. The shoe according to claim 1, wherein the upper body is formed of a knitted fabric.

13. The shoe according to claim 1, wherein the upper further includes a plurality of stitch portions connecting the first portion to the upper body and forming the gaps in the first portion through which the shoelace passes, the plurality of stitch portions being orthogonal to an extending direction of the first portion.

14. A method of manufacturing a shoe, the method comprising:

preparing a sole;

manufacturing an upper having an opening through which a foot of a wearer is inserted when the wearer puts on the shoe and including a shoelace tightening region located forward of the opening; and joining the upper to a top side of the sole, wherein manufacturing the upper includes:

preparing an upper body capable of, together with the sole, accommodating the foot of the wearer, forming a front-side folded portion and a rear-side folded portion by folding a tape member having a generally rectangular shape along respective fold portions, the tape member being higher in rigidity than the upper body, sewing a first portion of the tape member onto an outer surface of the upper body so as to be located in the shoelace tightening region and to extend in a front-rear direction of the upper, the first portion being a portion on one side in the tape member when viewed from the folded portions, attaching a front-side second portion of the tape member to the outer surface of the upper body so as to extend downward from the front-side folded portion to a peripheral side surface of the sole, the front-side second portion being a portion on the other side in the tape member when viewed from the folded portions, attaching a rear-side second portion of the tape member to the outer surface of the upper body so as to extend downward from the rear-side folded portion to a peripheral side surface of the sole, the rear-side second portion being a portion on the other side in the tape member when viewed from the folded portions, and wherein the first portion is sewn onto the upper body such that a plurality of gaps through which a shoelace passes are provided between the first portion and the upper body, and wherein the first portion of the tape member does not include any folds.

15. The method of claim 14, wherein a plurality of stitch portions are sewn into the first portion to connect it to the upper body and form the gaps in the first portion through which the shoelace passes, the plurality of stitch portions being orthogonal to an extending direction of the first portion.

16. A shoe comprising:

a sole; and an upper located above the sole and having an opening through which a foot of a wearer is inserted when the wearer puts on the shoe, and a shoelace tightening region located forward of the opening, wherein the upper further includes:

an upper body configured to, together with the sole, accommodate the foot of the wearer; and a tape member having a generally rectangular shape and being higher in rigidity than the upper body, the tape member being sewn onto an outer surface of the upper body, wherein the tape member includes:

a first portion located in the shoelace tightening region and extending in a front-rear direction of the upper, a front-side folded portion contiguous to a front end portion and a rear-side folded portion contiguous to a rear end portion of the first portion, each of the front-side and rear-side folded portions being formed by folding the tape member downward when viewed from the first portion, a front-side second portion extending downward from the front-side folded portion to a peripheral side surface of the sole, a rear-side second portion extending downward from the rear-side folded portion to the peripheral side surface of the sole, wherein the first portion is sewn onto the upper body such that a plurality of gaps through which a shoelace passes are provided between the first portion and the upper body, and wherein the front-side second portion and rear-side second portion are inclined rearward when viewed in a width direction of the upper and, wherein the rear-side second portion has a larger rearward inclination angle than that of the front-side second portion.

* * * * *